United States Patent [19]

Shieh

[11] Patent Number: 4,495,663

[45] Date of Patent: Jan. 29, 1985

[54] STRAP FOR USE WITH DIVING GOGGLES

[76] Inventor: Steve Shieh, 2-6th Fl. 13, Lane 118, Chung Ching S. Rd., Sec. 1, Taipei, Taiwan, 100

[21] Appl. No.: 410,179

[22] Filed: Aug. 20, 1982

[51] Int. Cl.[3] ..... A42B 1/24; A61F 9/02; A63B 33/00

[52] U.S. Cl. ..... 2/422; 2/426; 2/2.1 R; 2/452; 128/201.11

[58] Field of Search ..... 2/422, 2.1 R, 426, 427, 2/428, 440, 444, 452, 439; 224/181, 904; 24/3 A, 3 R

[56] References Cited

U.S. PATENT DOCUMENTS 2,182,104 12/1939 Wilen et al. ..... 2/440
3,249,271 5/1966 Allbritton ..... 224/181

*Primary Examiner*—Werner H. Schroeder
*Assistant Examiner*—J. L. Kravitz

[57] ABSTRACT

A strap for use with a pair of diving goggles includes a pair of rings provided at a slope across one half of the strap and incorporated therewith. The rings receive an aspiration pipe with the effect that the aspiration pipe is secured to stand at right angles with respect to the water level when the diver watches beneath him.

1 Claim, 3 Drawing Figures

STRAP FOR USE WITH DIVING GOGGLES

SUMMARY OF THE INVENTION

This invention relates to a strap for use with diving goggles. The strap preferably includes two rings disposed obliquely with respect to and on one wide of the strap. The rings are an integral part of the goggle strap. The obliqueness of the rings is designed such that an aspiration pipe supported in the rings is, in use, tilted rearwardly relative to the user's head to minimize penetration of surrounding waters into the pipe passages.

It is an object of the present invention to provide a strap for use with goggles and an aspiration pipe, the strap being such that the aspiration pipe is at an angle to avoid entry of water into the pipe. The aspiration pipe is held to the strap by a pair of rings and if one of the rings break off, the aspiration pipe will remain secured to the strap by the other ring and not drift away.

DETAILED DESCRIPTION OF PREFERRED EMBODIMENT

Figure 2:
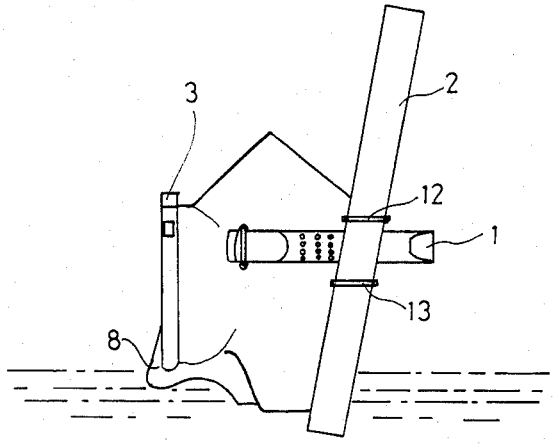
FIG. 2 is a view of the strap of the present invention in use when connected to an aspiration pipe and a pair of goggles, also showing part of the user's head.
Figure 3:
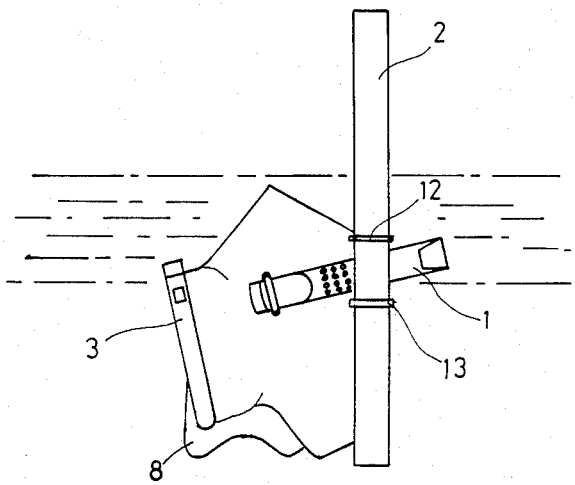
FIG. 3 is a view similar to that shown in FIG. 2, but with the user's head tilted slightly downwardly.
Figure 1:
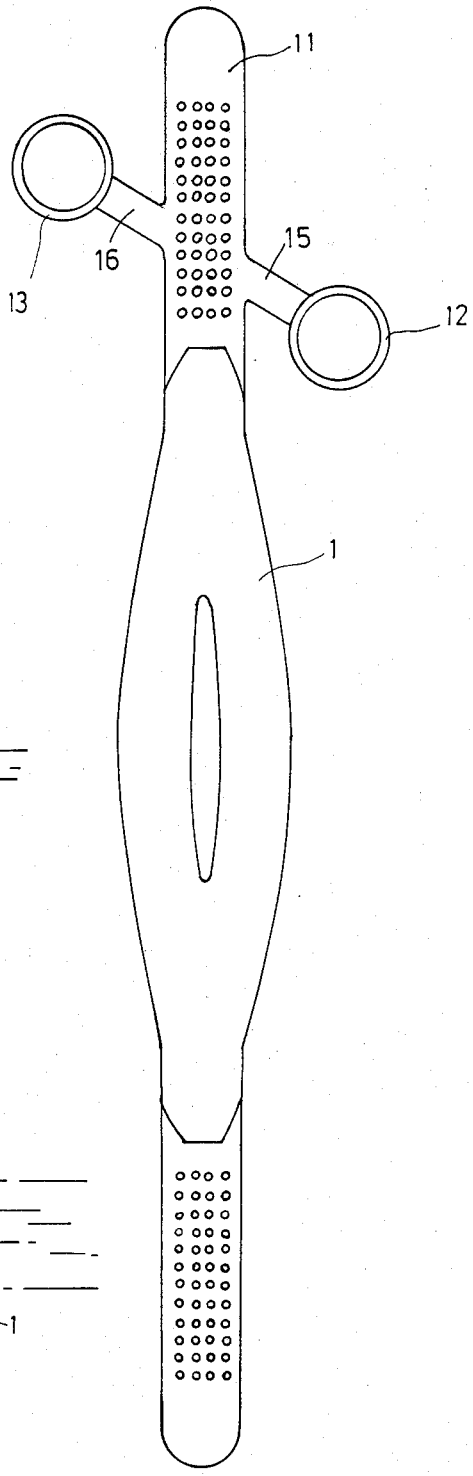
FIG. 1 is a front view of the goggle strap of the present invention.

Referring to FIG. 1, there is shown a front view of the strap of the present invention. On the left half 11 of the strap 1 there is an upper ring 12 and a lower ring 13 connected to the strap by arms 15 and 16 respectively. The arms 15 and 16 are at an angel relative to the strap 1, the longitudinal axes of the arms being coextensive. The rings 12 and 13 are integral with the strap 1. The effect of the angled arms 15 and 16 is that an aspiration pipe 2 passing through both rings, which have been bent through approximately 90 degrees so that the axes thereof correspond, is firmly secured to the strap 1. All that need be done with the aspiration pipe in further preparation for a diving is to adjust the elevation thereof. The effect of the arms 15 and 16 with rings 12 and 13 being disposed at an angle with respect to the strap and the goggles 3 can be clearly seen by comparing FIG. 2 and FIG. 3. The aspiration pipe 2 assumes a position which is perpendicular to the water level when the diver's head is bent downwardly. The angle of the diver's head can be seen from the position of the nose 8 and the goggles 3. When the aspiration pipe 2 is in such a position, the likelihood or chance of unwanted but otherwise possible swaying of the aspiration pipe is reduced thus keeping the open upper end of the pipe clear of water. If one of the rings 12 or 13 breaks, the aspiration pipe 2 would nevertheless remain tightly secured to the strap 1 by the other ring.

The strap of the present invention provides improved connection to an aspiration pipe when used in conjunction therewith, and as an integrated part of a pair of goggles. The strap may also be used by young people beginning swimming.

What is claimed is:

1. A strap for use with a pair of diving goggles and an aspiration pipe, the strap comprising:

an elongated member having first and second ends releasably connected to the pair of goggles, each end having an upper and a lower edge;

an arm integrally connected to both the upper and the lower edges of one of the ends of the strap, the longitudinal axes of the arms being coextensive with each other and disposed obliquely with respect to the upper and lower edges; and a ring integrally attached to the free end of each arm, the rings being adapted to support the aspiration pipe at an oblique angle relative to the strap when the rings are at substantially right angles to the arms so the aspiration pipe will in use tend to be substantially perpendicular to water level to minimize the chance of water entering the open end of the aspiration pipe.

* * * * *